US011142826B2

(12) United States Patent
Han et al.

(10) Patent No.: US 11,142,826 B2
(45) Date of Patent: Oct. 12, 2021

(54) SUBSTITUTION-TYPE ELECTROLESS GOLD PLATING SOLUTION CONTAINING PURINE OR PYRIMIDINE-BASED COMPOUND HAVING CARBONYL OXYGEN AND SUBSTITUTION-TYPE ELECTROLESS GOLD PLATING METHOD USING THE SAME

(71) Applicant: MK Chem & Tech Co., Ltd, Ansan-si (KR)

(72) Inventors: Deok-Gon Han, Siheung-si (KR); Tae-Hyon Sung, Siheung-si (KR); Jong-Han Song, Ansan-si (KR); Tae-Ho Lee, Anyang-si (KR); Hyuk-Suk Kwon, Seoul (KR)

(73) Assignee: MK CHEM & TECH CO., LTD, Ansan si (KR)

( * ) Notice: Subject to any disclaimer, the term of this patent is extended or adjusted under 35 U.S.C. 154(b) by 145 days.

(21) Appl. No.: 16/414,204

(22) Filed: May 16, 2019

(65) Prior Publication Data

US 2020/0095685 A1 Mar. 26, 2020

(30) Foreign Application Priority Data

Sep. 20, 2018 (KR) ..... 10-2018-0112851

(51) Int. Cl.
*C23C 18/40* (2006.01)
*C23C 18/42* (2006.01)
(Continued)

(52) U.S. Cl.
CPC ..... *C23C 18/42* (2013.01)

(58) Field of Classification Search
USPC ..... 106/1.05, 1.22, 1.23
See application file for complete search history.

(56) References Cited

U.S. PATENT DOCUMENTS 4,591,415 A * 5/1986 Whitlaw ..... C25D 3/62 205/118
5,169,514 A * 12/1992 Hendriks ..... C25D 3/48 106/1.18
(Continued)

FOREIGN PATENT DOCUMENTS

CN 103014685 A 4/2013
JP 2000-144441 A 5/2000
(Continued)

OTHER PUBLICATIONS

English translation of KR 10-1857596, May 2018; 30 pages.*
(Continued)

*Primary Examiner* — James E McDonough
(74) *Attorney, Agent, or Firm* — Lewis Roca Rothgerber Christie LLP

(57) ABSTRACT

A substitution gold plating solution for performing uniform gold plating directly on copper wiring of a printed circuit board is provided and a gold plating method using the same is provided, the solution comprising a purine-based compound or a pyrimidine-based compound having a carbonyl oxygen used as a localized corrosion inhibitor, a water-soluble gold compound, an aminocarboxylic acid as a complexing agent, a dicarboxylic acid as a conductivity improving agent, an α-hydroxycarboxylic acid and heteroaryl carboxylic acid as a base metal elution and reprecipitation preventing agent, a sulfite compound as a gold ion stabilizer, an axole compound as a surface corrosion inhibitor, other surfactants, crystal regulators, pH adjuster, and buffers. The substitution-type electroless gold plating solution according to the present invention prevents the localized corrosion of the copper surface, which is the base metal, and thus the gold plating film produced is excellent in solder mounting reliability.

13 Claims, 8 Drawing Sheets

(51) Int. Cl.

| | |
|---|---|
| *C23C 18/48* | (2006.01) |
| *C23C 18/44* | (2006.01) |
| *C23C 20/00* | (2006.01) |
| *C23C 18/00* | (2006.01) |
| *C23C 16/00* | (2006.01) |
| *C09D 5/10* | (2006.01) |
| *C09D 5/00* | (2006.01) |
| *B22F 7/00* | (2006.01) |

(56) References Cited

U.S. PATENT DOCUMENTS

| | | | | |
|---|---|---|---|---|
| 6,287,371 | B1 * | 9/2001 | Ota | C23C 18/42 106/1.18 |
| 6,855,191 | B2 * | 2/2005 | Kato | C23C 18/44 106/1.23 |
| 7,022,169 | B2 * | 4/2006 | Iwai | C23C 18/42 106/1.23 |
| 7,534,289 | B1 * | 5/2009 | Yomogida | C23C 18/44 106/1.23 |
| 9,416,453 | B2 * | 8/2016 | Lee | C23C 18/54 |
| 2004/0118317 | A1 * | 6/2004 | Iwai | C23C 18/44 106/1.23 |
| 2010/0071940 | A1 * | 3/2010 | Ejiri | H01L 23/49816 174/257 |
| 2017/0044671 | A1 * | 2/2017 | Milum | C23C 18/1844 |

FOREIGN PATENT DOCUMENTS

| | | | |
|---|---|---|---|
| JP | 2003-22167 | A | 1/2003 |
| JP | 2003-268586 | A | 9/2003 |
| JP | 2004-190093 | A | 7/2004 |
| JP | 2004-323963 | A | 11/2004 |
| JP | 2008-266712 | A | 11/2008 |
| JP | 2008-291348 | A | 12/2008 |
| JP | 2009-155671 | A | 7/2009 |
| KR | 10-2004-0050887 | A | 6/2004 |
| KR | 10-2010-0034336 | A | 4/2010 |
| KR | 10-1483599 | B1 | 1/2015 |
| KR | 10-1857596 | B1 | 5/2018 |
| KR | 101857596 | B1 * | 5/2018 |
| TW | 200416299 | A | 11/2003 |

OTHER PUBLICATIONS

English translation of KR 20100004562, Jan. 2010; 11 pages.*
English translation of JP 2009/155671, Jul. 2009; 11 pages.*
English translation of JP 2004/190093, Jul. 2004; 10 pages.*
English translation of the Japanese Office Action dated May 12, 2020 for Application No. JP 2019/081039; 3 pages.*
Purine Compound Structure, https://pubchem.ncbi.nlm.nih.gov/compound/Purine; downloaded Feb. 1, 2021; 42 pages.*
Honma et al., "Electroless Gold Plating by Disulfiteaurate Complex"; Plating and Surface Finishing, vol. 82, No. 4, pp. 89-92, Apr. 1995; 4 pages.*
English translation of JP 2003/268586, Sep. 2003; 14 pages.*
Pyrimidine-2-carboxylic acid Compound Structure, https://pubchem.ncbi.nlm.nih.gov/compound/Pyrimidine-2-carboxylic-acid; downloaded Feb. 2, 2021; 16 pages.*
Japanese Office action for Application No. JP 2019-081039, dated May 12, 2020, 3 pages.
Korean Notice of Allowance for Application No. 10-2018-0112851, dated Jun. 20, 2019, 3 pages.
Japanese Notice of Allowance for Application No. 2019-081039, dated Nov. 10, 2020, 2 pages.
Taiwanese Office Action dated Nov. 15, 2019 for Application No. 10821078360, 3 pages.
Chinese Office action for Application No. 201910376966.8, dated May 6, 2021, 6 pages.

* cited by examiner

| Condition | Example 1 | Example 2 | Example 3 | Comparative Example 1 | Comparative Example 2 |
|---|---|---|---|---|---|
| Exterior Picture |  |  |  |  |  |

Example 1

Example 2

Example 3

Comparative Example 1

Comparative Example 2

Example 1

Example 2

Example 3

Comparative Example 1

Comparative Example 2

| Condition | Example 1 | Example 2 | Example 3 | Comparative Example 1 | Comparative Example 2 |
|---|---|---|---|---|---|
| Post-Spread Picture |  |  |  |  |  |
| Degree of Spread | 833.50 | 871.47 | 855.57 | 626.32 | 609.38 |

SUBSTITUTION-TYPE ELECTROLESS GOLD PLATING SOLUTION CONTAINING PURINE OR PYRIMIDINE-BASED COMPOUND HAVING CARBONYL OXYGEN AND SUBSTITUTION-TYPE ELECTROLESS GOLD PLATING METHOD USING THE SAME

CROSS-REFERENCE TO RELATED APPLICATION

This application claims priority to Korean Patent Application No. 10-2018-0112851 filed on Sep. 20, 2018, and all the benefits accruing therefrom under 35 U.S.C. § 119, the contents of which is incorporated by reference in its entirety.

BACKGROUND OF THE INVENTION

1. Field of the Invention

The present invention relates to a novel substitution-type electroless gold plating solution for performing direct gold plating on a copper wiring of a printed circuit board and a gold plating method using the same. Various electroless gold plating methods use electroless nickel plating as a base metal of the gold plating. It is known that nickel plating is plated between copper and a gold plating film in order to block elution and diffusion of copper onto the gold plating surface and increase the adhesion strength of the gold plating, and the thickness thereof is preferably 3 to 7 μm. However, if the intermediate nickel plating layer is omitted from the copper wiring of the printed circuit board and direct gold plating is performed, there is a problem that localized corrosion is generated on the copper surface, forming a pitting or crevice corrosion, thereby making it difficult to obtain uniform gold plating.

The present invention relates to a substitution-type electroless gold plating solution and a gold plating method using the same, the solution containing, a localized corrosion inhibitor that prevents localized corrosion of a copper surface, an alpha hydroxycarboxylic acid and a heteroaryl carboxylic acid which inhibits the elution of a base metal and easily forms a complex salt with the substitution reaction product to improve the stability of the gold plating bath, a cyanide compound or a sulfite compound as a gold ion stabilizer, and an azole compound as a surface corrosion inhibitor.

2. Description of the Related Art

Gold plating is most suitable for final surface treatment of printed circuit boards. It has excellent physical properties such as electrical conductivity, chemical resistance and oxidation resistance of gold as well as solder mounting reliability when mounting electronic components. Nickel plating is used as the base metal of electroless gold plating. As methods in which electroless gold plating is performed after electroless nickel plating is performed on a copper wiring of a printed circuit board, Electroless Ni/Immersion Au (ENIG)

Electroless Ni/Autocatalytic Au (ENAG)

Electroless Ni/Immersion Au/Autocatalytic Au (ENIGAG)

are major methods.

In addition, when a lead-free solder is used due to RoHs (Restrictions on the use of certain Hazardous Substances), the melting point of Sn/Pb solder is 183° C., whereas when a (Sn/3.5Ag/0.5Cu) solder is used as a lead-free solder, the melting point is 220° C. At this time, the copper and nickel, which are the base metals, are diffused to the gold surface due to overheating which increases by 40° C. or more during component mounting.

A reflow process is performed two or more times on major products of printed circuit boards such as BGA (Ball Grid Array) and FC (Flip Chip) BGA. Since heat is continuously applied, due to the generation of hetero compounds and the elution of the base metal on the gold surface, black pad defects occur. In order to prevent such occurrences, methods of Electroless Nickel/Electroless Palladium/Immersion Au (ENEPIG) for performing electroless palladium plating between electroless nickel and gold plating have also been developed and popularized.

ENIG, ENAG, ENIGAG and ENEPIG processes are mainly used for gold plating on copper wiring of printed circuit boards. All of these processes require performing electroless nickel plating to use nickel as the base metal and perform gold plating. Recently, there has been an active demand for commercialization of direct electroless gold plating methods for directly performing gold plating on copper wiring of printed circuit boards. As examples of reasons for such demand, reasons (1) to (3) can be as follows.

(1) Due to high integration of semiconductors, the circuit of the printed circuit board to be mounted thereon is being continuously miniaturized, and recently, a line/space of up to 10 μm or less is being required. The thickness of nickel as a base plating for a conventional electroless gold plating is required to be 3 to 7 μm, but it is impossible to apply electroless nickel plating when the line/space is 10 μm or less.

(2) As electronic products are becoming wireless, in the case of an RF module used for low-current high-frequency, electric resistance is increased due to nickel plating, and a skin effect occurs in which electric current flows along the surface. Thus, there is a demand for a plating method alternative to nickel plating.

(3) In the case of flexible printed circuit boards (PCBs), fatal defects can occur such as bending cracks due to repetitive use. This occurs in the nickel layer, so there is a demand for a plating method having a better bending resistance than nickel plating.

That is, there is an urgent need for developing a new method that can satisfy the above-mentioned demands such as, an ultra-fine circuit board having a line/space of 10 μm or less, a substrate on which electronic components of wireless RF high-frequency characteristics are mounted, or a flexible substrate that requires repetitive bending properties or the like.

As methods for excluding nickel plating as a base metal in an existing electroless gold plating method, the DIG (Direct Immersion Au) method in which gold plating is performed directly on the copper wiring of a printed circuit, as well as the ESIG (Electroless Ag/Immersion Au) method and the EPIG (Electroless Pd/Immersion Au) method are being studied, but have yet to be commercialized.

Various studies are being made on a method of directly performing electroless gold plating on a copper wiring of a printed circuit board.

Patent Document 1 discloses that a sulfite gold salt and an aminocarboxylic acid compound are used as a non-cyanide replacement gold plating solution capable of forming a uniform gold coating, and that even without containing a separate sulfite, the self-decomposition of the plating solution is suppressed and so the liquid stability is high. Further, when the substrate is immersed at a temperature of 70° C. with a pH of 6.5 for 30 minutes, a gold coating free of any blotches can be obtained.

Patent Document 2 discloses that potassium gold cyanide is used as a cyanide replacement gold plating solution and carboxylic acid or amines are used as a complexing agent, providing excellent adhesion and corrosion resistance. Further, when the substrate is immersed at a temperature of 80° C. with a pH of 6.0 for 10 minutes, a thickness of 0.05 μm of gold can be obtained, and appearance-wise, the gloss of the gold plating is excellent.

Patent Document 3 discloses a reduction electroless gold plating solution wherein a phenyl compound is used as a reducing agent, thiosiliate and monoalkanolamine are used as a complexing agent and a thiazole compound is used as a stabilizer. Further, when the substrate is immersed at a temperature of 65° C. with a pH of 7.5 for 1 hour, a thickness of 0.08 μm of gold can be obtained.

Patent Document 4 discloses that a water-soluble cyanide gold compound is used, ethylenediamine tetramethylene phosphonic acid is used as a complexing agent, hydrazine and a derivative thereof are used as a surface treating agent, and polycarboxylic acid and pyridinium carboxylate compound are used to prevent localized embrittlement of the base metal, thereby increasing the adhesion of the gold plating film, and it is possible to obtain a gold coating excellent in appearance with excellent solder bonding strength.

As prior arts, there are (Patent Document 1) Japan Laid-Open Patent Publication No. 2009-155671 (Jul. 16, 2009), (Patent Document 2) Japan Laid-Open Patent Publication No. 2004-323963 (Nov. 18, 2004), (Patent Document 3) Japan Laid-Open Patent Publication No. 2008-266712 (Jun. 11, 2008), and (Patent Document 4) Korean Granted Patent Publication No. 10-1483599 (Jan. 12, 2015).

SUMMARY OF THE INVENTION

When electroless gold plating is directly applied to the copper wiring of a printed circuit board, localized erosion occurs to cause corrosion or cracking on the surface of the copper, which in turn causes incomplete plating adhesion between the copper surface and the gold plating critical surface. As a result, the adhesion strength between the copper surface and the gold plating is reduced, and copper is eluted and diffused to the gold plating surface during component mounting, resulting in discoloration or oxidation of the gold plating surface. Therefore, in order to put the electroless gold plating method into practical use, research to prevent the occurrence of localized erosion on the copper surface should be preceded.

Further, it is necessary to prevent copper ions eluted by a substitution reaction from being easily dissolved and re-precipitated together with gold, and to improve the stability of the gold plating solution long-term maintenance of the life of the gold plating bath. Therefore, it is necessary to maintain not only reliability of solder mounting but also the quality of appearance and structure of gold plating, corrosion resistance, and the like.

As a result of a study on a method for preventing the fatal occurrence of localized erosion on a copper surface when gold plating is performed directly on the copper wiring of a printed circuit board, the present inventors found that the localized erosion phenomenon occurs when a potential difference is generated in a case where there is a slight non-uniformity of the copper surface due to the size of the crystal grains of the copper metal, defects of the surface, presence of impurities, etc., so that an anode and a cathode are formed and an electrochemical reaction occurs, and copper is ionized at the anode to initiate an oxidation reaction to release electrons, and the reaction is accelerated which leads to localized erosion and causes the formation of a pitting or crevice.

Accordingly, the inventors of the present invention have completed a study on a method of initially preventing an oxidation reaction which initiates an unnecessary electrochemical reaction besides the deposition of gold plating by a normal substitution reaction on a copper surface and leads to localized erosion.

That is, the present inventors were able to form a gold plating film that is uniform and completely in close contact that does not form any pitting or crevice due to localized corrosion, by using a localized corrosion inhibitor that inhibits localized corrosion of a copper surface, such as,

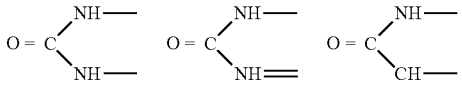

wherein, as the localized corrosion inhibitor, purine-based or pyrimidine-based compound containing carbonyl oxygen (Carbonyl Oxygen) acts on an oxidation reaction which causes localized erosion of the copper surface to prevent localized erosion from proceeding, and by initiating a normal gold plating substitution deposition reaction first.

Further, in order to maintain the long-term stability of the gold plating bath and provide uniformity of gold plating, by using a water-soluble gold compound, a complexing agent, a conductivity improving agent, a base metal elution and re-precipitation preventing agent, a gold ion stabilizer, a surface corrosion inhibitor and etc., it was possible to ensure excellent solder mounting reliability and the like.

The novel substitution-type electroless gold plating solution of a direct gold plating method according to the present invention wherein gold plating is performed directly on the copper wiring of a printed circuit board provides uniformity of gold plating by preventing the formation of pitting and crevice corrosion caused by localized corrosion of copper and gold plating critical surfaces.

The present invention, as a novel substitution-type electroless gold plating solution, is used in Gold Strike plating for obtaining a uniform gold coating that is completely in close contact with the copper surface and wherein corrosion does not occur on the copper surface. Reduced electroless gold plating (MK Chem&Tech NEOZEN TG) was immediately performed to obtain a gold coating having a thick thickness.

Moreover, the produced gold plating has an excellent solder mounting reliability, and can be commercialized by increasing the stability and the use time of the gold plating bath to improve productivity and quality.

Further, the novel substitution-type electroless gold plating solution of the present invention can be commercialized for use in wire bonding for microcircuits because the gold plating solution of the present invention can be used as a gold strike in place of electroless Ni in the ENEPIG process.

DETAILED DESCRIPTION OF THE INVENTION

Figure 1A:
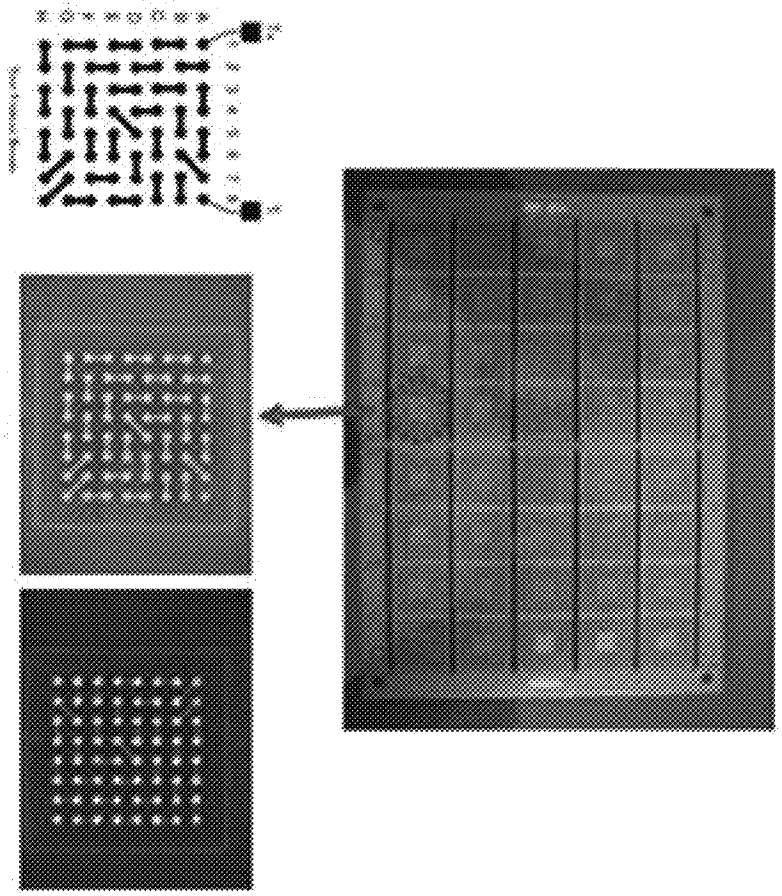
FIGS. 1A and 1B are photographs illustrating a substrate for gold plating evaluation used in the present invention.

A substitution-type electroless gold plating solution of the present invention is used for performing gold plating on a copper wiring of a printed circuit board, and includes the following components.

(A) A purine-based compound or a pyrimidine-based compound having carbonyl oxygen, as a localized corrosion inhibitor (B) A water-soluble gold compound (C) A complexing agent (D) Dicarboxylic acid as a conductivity improving agent (E) As a base metal elution and re-precipitation preventing agent, a (E-1) nitrogen-containing heteroaryl carboxylic acid and/or an (E-2) α-hydroxycarboxylic acid (F) A gold ion stabilizer (G) A surface corrosion inhibitor (H) As other additives, a crystal adjusting agent, a pH adjusting agent, a surfactant, etc.

The substitution-type electroless gold plating method of the present invention includes preparing a gold substrate to be plated having a metal surface selected from copper or a copper alloy, and contacting the substrate with the above-mentioned substitution-type electroless gold plating solution.

Hereinafter, the present invention will be described in further detail.

[Substitution-Type Electroless Gold Plating Solution]

(A) Localized Corrosion Inhibitor

In the present invention, a (A) localized corrosion inhibitor has the function of preventing localized corrosion phenomena such as a pitting or crevice corrosion from occurring in a case where gold plating is performed directly on a copper surface.

The above-mentioned (A) localized corrosion inhibitor may be a purine or pyrimidine-based compound having carbonyl oxygen, and examples of the purine and pyrimidine-based compound may include compounds represented by the following Chemical Formulas 1 and 2, but are not limited to the same.

<Chemical formula 1>

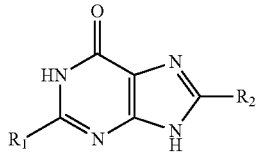

<Chemical formula 2>

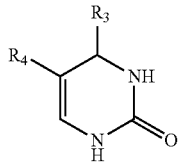

(In the above-mentioned Chemical formula 1 and 2, $R_1$, $R_2$, $R_3$, $R_4$ are =O, —$NH_2$, —$CH_3$ or —H, respectively.)

The purine and pyrimidine-based compound of the above-mentioned Chemical formula 1 and 2 and the like have carbonyl oxygen containing nitrogen, such as the groups represented by the following Chemical formulas (a) to (c).

<formula a>

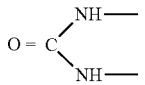

<formula b>

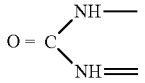

<formula c>

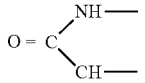

Herein, the purine or pyrimidine-based compound having carbonyl oxygen may be, 2-amino-9H-purine-6(H)-one,
3,7-dihydro-purine-2,6-dione,
7,9-dihydro-1H-purine-2,6,8(3H)-trione,
5-methyl-pyrimidine-2,4(1H,3H)-dione,
2,4(1H,3H)-pyrimidine-dione, or
4-amino-1H-pyrimidine-2-one, and the like, but are not limited thereto. In addition, pyrrolidine and azepine compounds such as 2H-azepin-2-one with carbonyl oxygen, pyrrolidon-2-one and the like can also be used as localized corrosion inhibitors.

The amount of the above-mentioned (A) local corrosion inhibitor in the substitution-type electroless gold plating solution of the present invention is 0.05 to 10 g/L, preferably 0.1 to 3 g/L.

(B) Water-Soluble Gold Compound

In the present invention, the (B) water-soluble gold compound is a gold ion source. The water-soluble gold compound (B) may be one selected from a group consisting of for example, potassium gold(I) cyanide, potassium gold (III) cyanide, potassium gold(I) chloride, potassium gold (III) chloride, potassium gold sulfite, sodium gold sulfite, potassium gold thiosulfate, sodium gold thiosulfate, and a mixture thereof. Preferably, the water-soluble gold compound may be selected from potassium gold (I) cyanide and sodium gold sulfite, but is not limited thereto.

The concentration of the water-soluble gold salt in the substitution-type electroless gold plating solution of the present invention may range from 0.1 to 10 g/L, and preferably from 0.3 to 5 g/L, but is not limited thereto.

(C) Complexing Agent

In the present invention, the (C) complexing agent dissolves, coordinates, and complexes metal ions in the gold plating solution to prevent precipitation of metals or metal ions.

Preferably, the above-mentioned (C) complexing agent is a multi-coordinating ligand, for example, may be selected from the group consisting of, alkylene polyamine polyacetic acid such as ethylenediamine tetraacetic acid (EDTA), diethylenetriamine pentaacetic acid (DTPA), triethylenetetraamine hexaacetic acid, propanediamine tetraacetic acid, N-(2-hydroxyethyl)ethylenediamine triacetic acid, 1,3-diamino-2-hydroxypropane N,N,N',N'-tetraacetic acid, bis-(hydroxyphenyl)-ethylenediamine diacetic acid, diaminocyclohexane tetraacetic acid, ethylene glycol-bis((β-aminoethyl ether)-N,N'-tetraacetic acid) and the like; polyamine such as N,N,N',N'-tetrakis-(2-hydroxypropyl)-ethylenediamine, ethylenediamine, triethylenetetramine, diethylenetriamine, tetrakis(aminoethyl) ethylenediamine and the like; and sodium salts, potassium salts or ammonium salts and a mixture thereof. Preferably, as an example of the complexing agent, there is alkylene polyamine polyacetic acid and more preferably, there are ethylenediamine tetraacetic acid (EDTA), diethylenetriamine pentaacetic acid (DTPA), triethylenetetramine hexaacetic acid, propanediamine tetraacetic acid, and the like, but is not limited thereto.

In the present invention, the (C) complexing agent may be used in various concentrations, but in general, the complexing agent exists in the gold plating solution in a stoichiometric equivalent (relative to the amount of gold ions) or stoichiometric excess amount so that all the gold ions can be complexed. In the present invention, the term "stoichiometric" means equimolar. In general, complexing agents are present in an excess amount relative to gold ions, i.e., in high molar concentrations. The molar ratio of complexing agent to gold ion is generally ≥1:1, preferably ≥1.2:1, more preferably ≥2.0:1 and especially preferably ≥3.0:1. The complexing agent in the substitution-type electroless gold plating solution of the present invention is used in an amount of 1 to 100 g/L, preferably in an amount of 5 to 50 g/L.

(D) Conductivity Improving Agent

In the present invention, for example, a dicarboxylic acid can be used as a (D) conductivity improving agent.

The dicarboxylic acid is preferably an aliphatic dicarboxylic acid, and for example may be selected from the group consisting of oxalic acid, malonic acid, succinic acid, glutaric acid, adipic acid, pimelic acid, suberic acid, azelaic acid, sebacic acid, undecanoic acid, dodecanoic acid, 3,3-dimethylentanoic acid, cyclopentane dicarboxylic acid, cyclohexane dicarboxylic acid, and a mixture thereof. The dicarboxylic acid may be used in a form of an alkali metal salt, an alkaline earth metal salt, or an ammonium salt, and specifically may be used in a form of a sodium salt, a potassium salt or an ammonium salt, but is not limited thereto.

The dicarboxylic acid in the substitution-type electroless gold plating solution of the present invention is used in an amount of 1 to 200 g/L, and preferably used in an amount of 10 to 80 g/L.

(E) Base Metal Elution and Re-Precipitation Preventing Agent

In the present invention, as a (E) base metal elution and re-precipitation preventing agent, for example, a (E-1) nitrogen-containing heteroaryl carboxylic acid and/or an (E-2) α-hydroxycarboxylic acid and etc. can be used.

(E-1) Nitrogen-Containing Heteroaryl Carboxylic Acid

In the present invention, as a base metal elution and re-precipitation preventing agent, the (E-1) nitrogen containing heteroaryl carboxylic acid may be for example, selected from the group consisting of heteroaryl carboxylic acid wherein the ring nitrogen are all aromatic nitrogen, such as imidazole, pyridine, pyrazine, pyrimidine or pyridazine and 1 to 3 carboxylic acid groups are substituted. More specifically, the nitrogen-containing heteroaryl carboxylic acid may be selected from the group consisting of an imidazole carboxylic acid, imidazole dicarboxylic acid, pyridine carboxylic acid, pyridine dicarboxylic acid, pyrimidine carboxylic acid, pyrimidine dicarboxylic acid, pyridazine carboxylic acid, pyridazine dicarboxylic acid, a pyrazine carboxylic acid, pyrazine dicarboxylic acid, and a mixture thereof. Preferably, the nitrogen-containing heteroaryl carboxylic acid may be selected from the group consisting of imidazole-2-carboxylic acid, imidazole-4-carboxylic acid, imidazole-2,4-dicarboxylic acid, imidazole-4,5-dicarboxylic acid;

pyridine-2-carboxylic acid (picolinic acid), pyridine-3-carboxylic acid (nicotinic acid), pyridine-4-carboxylic acid (isonicotinic acid), pyridine-2,3-dicarboxylic acid, pyridine-2,4-dicarboxylic acid, pyridine-2,5-dicarboxylic acid, pyridine-2,6-dicarboxylic acid;

pyrimidine-3,4-dicarboxylic acid, pyrimidine-3,5-dicarboxylic acid, pyrimidine-2-carboxylic acid, pyrimidine-4-carboxylic acid, pyrimidine-5-carboxylic acid, pyrimidine-2,4-dicarboxylic acid, pyrimidine-2,5-dicarboxylic acid, pyrimidine-4,5-dicarboxylic acid, pyrimidine-4,6-dicarboxylic acid;

pyridazine-3-carboxylic acid, pyridazine-4-carboxylic acid, pyridazine-3,4-dicarboxylic acid, pyridazine-3,5-dicarboxylic acid, pyridazine-4,5-dicarboxylic acid;

pyrazine-2-carboxylic acid, pyrazine-2,3-dicarboxylic acid, pyrazine-2,5-dicarboxylic acid, pyrazine-2,6-dicarboxylic acid; and a mixture thereof, but not limited thereto.

In the (E-1) nitrogen-containing heteroaryl carboxylic acid of the present invention, the nitrogen is located in the heteroaryl ring and each represents aromatic nitrogen, and the carboxyl group is structurally characterized by being directly attached to the carbon atom of the heteroaryl ring. Such a heteroaryl group shows a n-electron-deficient aromatic ring, but promotes or activates a complex with a metal ion due to the influence of a carboxyl group directly bonded to an aromatic carbon atom of the heteroaryl ring and thereby it appears that the attachment to the metal surface can be promoted or activated accordingly.

According to a variant of the invention, the aforementioned (E-1) nitrogen-containing heteroaryl carboxylic acid may further comprise nitrogen which is not located on the heteroaryl ring.

The (E-1) nitrogen-containing heteroaryl carboxylic acid of the present invention may be used in various concentrations, but is preferably 0.1 to 25 g/L, and more preferably 0.5 to 10 g/L.

(E-2) α-hydroxycarboxylic Acid

In the present invention, the (E-2) α-hydroxycarboxylic acid functions as a base metal elution and re-precipitation preventing agent. The (E-2) α-hydroxycarboxylic acid is preferably an aliphatic α-hydroxycarboxylic acid and for example, may be selected from the group consisting of hydroxymonocarboxylic acid such as glycolic acid, lactic acid, hydroxybutyric acid, hydroxyvaleric acid, hydroxypentanoic acid, hydroxycaproic acid, hydroxyheptanoic acid, and α-hydroxydicarboxylic acid such as malic acid, tartaric acid, citric acid, and a mixture thereof, but is not limited thereto.

According to a variant of the invention, as the (E-2) α-hydroxycarboxylic acid, some or all of an α-keto carboxylic acid such as meso oxalic acid, oxaloacetic acid and the like may be used instead.

In the present invention, the (E-2) α-hydroxycarboxylic acid may be used in the substitution-type electroless gold plating solution in an amount of 1 to 20 g/L, and more preferably in an amount of 3 to 10 g/L.

According to one preferable embodiment of the present invention, (E-2) α-hydroxycarboxylic acid and (E-1) nitrogen-containing heteroaryl carboxylic acid can be used in combination.

(F) Gold Ion Stabilizer

In the present invention, in the electroless gold plating, the life of the gold plating bath is prolonged by increasing the stability of the gold ions, and in order to suppress the deterioration of the quality of the gold plating, (F) a gold ion stabilizer such as a cyanide compound or sulfite compound may be added.

Examples of the cyanide compound include sodium cyanide, ammonium cyanide, potassium cyanide, and the like. Examples of the sulfite compound include a sulfite compound having $SO_3^{2-}$.

In the substitution-type electroless gold plating solution of the present invention, the (F) gold ion stabilizer for stabilizing the gold ion complex is used in an amount of 0.1 to 20 g/L, preferably 2 to 10 g/L.

(G) Surface Corrosion Inhibitor

In the substitution-type electroless gold plating solution of the present invention, in addition to the above-mentioned components, a surface corrosion inhibitor for further inhibiting the corrosion of the base metal surface may be contained.

The (G) surface corrosion inhibitor may contain an azole compound having one or more nitrogen atoms and two or more other elements in a 5-membered heterocycle. The azole compound forms a strong N—Cu bond on the copper surface to form a nano-sized protective film, thereby preventing formation of $Cu_2O$ on the copper surface.

Examples of the azole compound include imidazole, pyrazole, triazole, tetrazole, thiazole, isothiazole, isoxazole, and oxazole. More specifically, examples of the azole compound include imidazole, 2-aminoimidazole, 4-aminoimidazole, 5-aminoimidazole, 2-aminobenzoimidazole, 2-mercaptobenzoimidazole, 1-phenyl-4-methylimidazole, 1-(p-tolyl)-4-methylimidazole, 4-methyl-5-hydroxymethylimidazole, 3-amino-1,2,4-triazole, 4-amino-1,2,4-triazole, 5-amino-1,2,4-triazole, 1,2,4-triazole, 3-amino-5-mercapto-1,2,4-triazole, 4-amino-1,2,3-triazole, 5-amino-1,2,3-triazole, 1,2,3-triazole, benzotriazole, methylbenzotriazole, tetrahydrobenzotriazole, nitrobenzotriazole, 3-amino-5-methylthio-1,2,4-triazole, 5-mercapto-1-1-methyl-tetrazole, 5-mercapto-1-phenyl-tetrazole, 5-phenyl-tetrazole, 5-amino-tetrazole, 5-methyl-tetrazole, trimethylene tetrazole, 1-phenyl-5-mercapto-tetrazole, phenyl-4H-1,2,4-triazole-3-thione, 2-amino-thiazole, 2-mercaptobenzothiazole, 2.2'-dithiobizbenzothizole, 2-amino-5-ethylthio-1,3,4-thiadiazole, 2-amino-5-ethyl-1,3,4-thiadiazole, 2-amino-1,3,4-thiodiazole, 2-mercaptobenzozazole, 1,3,4-triazole phosphonate, and the like, but are not limited thereto.

The concentration of the (G) surface corrosion inhibitor in the substitution-type electroless gold plating solution of the present invention is 0.0001 to 10 g/L, preferably 0.001 to 5.0 g/L.

(H) Other Additives

In the case where the characteristics of the gold plating solution are not deteriorated, the substitution-type electroless gold plating solution of the present invention may further include other additives, for example, one a surfactant, a crystallization modifier, a pH adjuster, a buffer, a flattening agent, a thickness controlling agent, an antifoaming agent, and the like.

The surfactant is used for controlling the wettability between the plating solution and the metal surface and for refining the plating particle size and examples include anionic, cationic, nonionic or amphoteric surfactants, but preferably the surfactant is selected from an anionic surfactant. The surfactant may be added in an amount of about 0.001 to 10 g/L, preferably 0.005 to 1.0 g/L in the substitution-type electroless gold plating solution of the present invention.

In the present invention, by containing an additive selected from the group consisting of a thallium compound, a lead compound and an arsenic compound, the appearance of the gold coating can be further improved and the inhibition of uneven appearance can be further improved.

Further, in order to stabilize the pH of the plating solution, a buffer selected from an inorganic salt and an organic salt may be used. In the present invention, since a dicarboxylic acid and/or an α-hydroxycarboxylic acid acid may act as a buffer, a separate buffer is not used, but if necessary, an inorganic salt such as a phosphate, a borate or the like, or an organic salt such as phthalate, tartrate, lactate, acetate or the like may be added as a buffer.

[Electroless Gold Plating Method]

In the gold plating method of the present invention, according to the conventional electroless gold plating method, it can be carried out by using the aforementioned electroless gold plating solution.

For example, the gold plating method of the present invention performs preparing a substrate to be plated and a gold strike wherein the substrate is brought into contact with the gold plating solution, and after the strike gold plating, a conventional electroless gold plating (substitution-reduction type) is performed.

The substrate to be plated may be a metal substrate or a substrate having a metal coating, and the metal may be copper or a copper alloy. In addition, the substrate to be plated may be defined as a substrate having a surface made of metal to be substituted that takes up a part of or all of the substrate. That is, the substrate may be defined as a substrate having a metal surface.

The method of producing the substrate to be plated is not particularly limited, but for example, copper or a copper alloy can be formed as a portion to be plated by various methods such as mechanical processing such as rolling, electroplating, electroless plating, vapor phase plating and the like.

The gold-plating thin film that is formed on the part to be plated may have a thickness of normally 0.02 to 0.5 μm, preferably 0.03 to 0.3 μm, more preferably 0.03 to 0.1 μm. The solder ball to be mounted on the gold coating may have a diameter of 100 μm to 1 mm, preferably 200 μm to 0.8 mm, depending on the size of the connecting portion (pad). As the solder composition, various compositions generally referred to as Pb-free solders other than conventional Sn—Pb-based materials can be used.

Meanwhile, in the step of performing substitution-type electroless gold plating by contacting the gold plating solution with the substrate to be plated, the gold plating solution is used at a pH of 4 to 8, preferably at a pH of 5 to 7, more preferably at about pH 6. At this time, potassium hydroxide, sodium hydroxide, ammonium hydroxide, or the like can be used as the pH adjusting agent.

In the aforementioned step of performing the gold plating, the temperature of the gold plating solution is not particularly limited, but is generally 60 to 95° C., preferably 70 to 85° C.

Further, according to the present invention, by the electroless gold plating method using the aforementioned electroless gold plating solution, a gold plating film formed on the substrate to be plated having a thickness of normally 0.02 to 0.5 μm, preferably 0.03 to 0.3 μm, more preferably 0.03 to 0.1 μm, and a substrate including the gold plating film, for example, a substrate for electric and electronic parts may be provided.

The electroless gold plating solution according to the present invention prevents localized corrosion of copper, to allow a complete adherence between the gold plating film that is formed and copper as the base metal. It can be seen that the gold plating film produced using the electroless gold plating solution has excellent solder bonding strength and solder spreadability. Further, the substitution-type electroless gold plating solution according to the present invention can effectively prevent re-precipitation with gold by easily and selectively complexing the metal substituted and dissolved from the base metal. Thus, the stability of the gold plating bath is improved and the use time of the gold plating bath increases, making it possible to improve productivity and quality and reduce defects.

The advantages and effects of the present invention will be explained in more detail by the following exemplary embodiments, but the present invention is not limited thereto.

Example

Figure 1B:
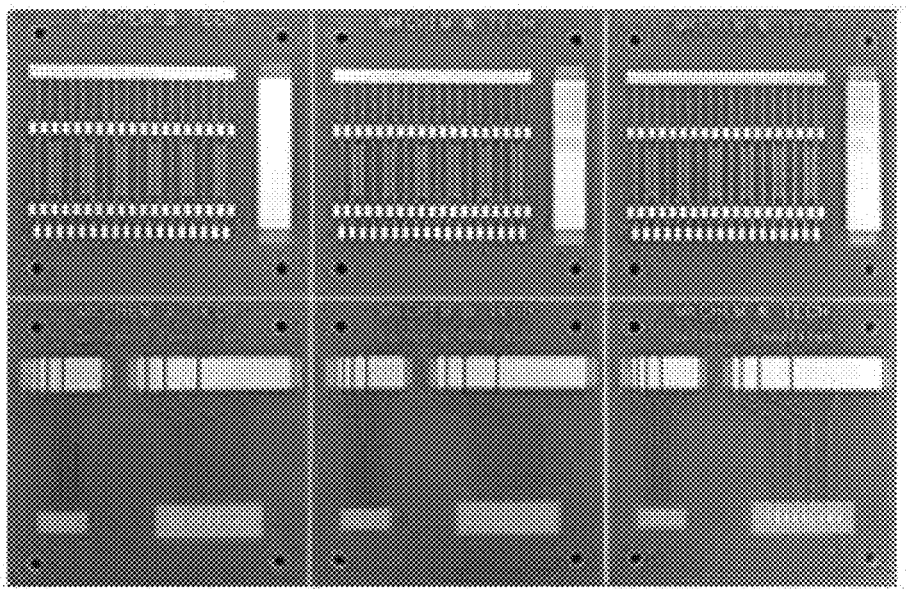

The PCB substrate used in this embodiment is an SMD type FR-4 substrate having a thickness of 1 mm. FIGS. 1A and 1B are photographs illustrating a substrate for gold plating evaluation used in the present invention.

The pad opening size formed on the substrate has a size of 350 μm and the pitch size was 800 μm and was formed in the pattern shown in FIG. 1A. The manufactured circuit boards were composed into a daisy chain, and were designed to be electrically connected to perform a soldering evaluation.

Further, as shown in FIG. 1B, a substrate was designed on which a galvanic reaction can take place by connecting a large area and a narrow pad into a circuit, to evaluate plating rate, plating appearance(exterior), and plating adhesion. In addition, the content of the gold compound was converted on the basis of the weight of gold (Au).

Figure 2:
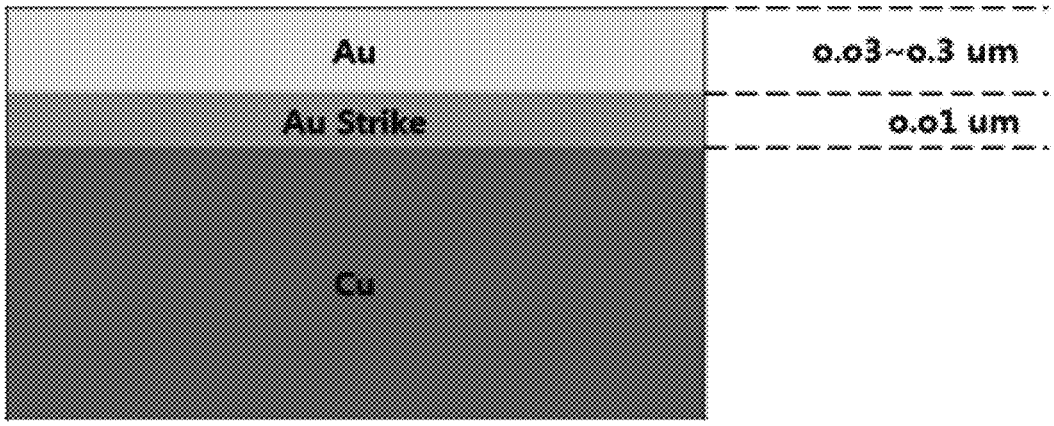
FIG. 2 is a schematic diagram illustrating the structure and thickness of a test substrate and a plated layer after gold plating according to the present invention.

The manufacturing process of the test substrate is as shown in Table 1 below, and the schematic structure and thickness of the test substrate and the plating layer after gold plating are shown in FIG. 2.

TABLE 1

| Category | Process | Drug name | Conditions Temperature (° C.) | Conditions Time (min) |
|---|---|---|---|---|
| Pretreatment | Degreasing | Acid clean 820 | 40° C. | 5 |
| Pretreatment | Soft etching | MKS-3000 | 25° C. | 5 |
| Pretreatment | Acid cleaning | sulfuric acid | 25° C. | 1 |
| Gold strike | Electroless Gold (Substitution-type) | Present invention | | |
| Gold Thickening (0.03~0.3 μm) | Electroless Gold (Reduction-type) | NEOZEN TG | 80° C. | 20 |

(In Table 1, drugs used for degreasing, soft etching, and electroless gold (reduction-type) are products of MK Chem&Tech Company)

Example 1

According to the components, contents and conditions shown in Table 2, 1 g/L (with respect to gold content) of potassium gold cyanide, 20 g/L of EDTA-2Na, 2 g/L of 3-pyridinecarboxylic acid, 40 g/L of oxalic acid, 5 g/L of citric acid, 5 g/L of sodium sulfite, 1.0 g/L of 2,4(1H,3H)-pyrimidine-dione were added to deionized water to prepare a substitution-type electroless gold plating solution according to the present invention.

Potassium hydroxide was added to adjust the pH to 6.0. The test substrate was subjected to gold strike plating for 5 minutes at a plating bath at a temperature of 75° C. followed by electroless gold plating (NEOZEN TG/product of MK Chem&Tech Company).

TABLE 2

| | Content | Example 1 | Example 2 | Example 3 | Comparative Example 1 | Comparative Example 2 |
|---|---|---|---|---|---|---|
| Potassium gold cyanide (gold content) | g/L | 1 | 1 | 1 | 1 | 1 |
| EDTA-2Na | g/L | 20 | 20 | 20 | 20 | 20 |
| 3-pyrimidine carboxylic acid | g/L | 2 | 2 | 2 | 2 | 2 |
| Oxalic acid | g/L | 40 | | 40 | 40 | |
| Succinic acid | g/L | | 30 | | | 30 |
| Citric acid | g/L | 5 | 5 | 5 | | |
| Sodium sulfite | g/L | 5 | 5 | 5 | 5 | 5 |
| 2-amino-9H-purine-6(H)-one | g/L | | 0.2 | | | |

TABLE 2-continued

| | Content | Example 1 | Example 2 | Example 3 | Comparative Example 1 | Comparative Example 2 |
|---|---|---|---|---|---|---|
| 2,4(1H,3H)-pyrimidine-dione | g/L | 1.0 | | 1.0 | | |
| Benzotriazole | mg/L | | 50 | | 50 | |
| 2-amino-thiazole | mg/L | | | 50 | | |
| Conditions pH | | 6.0 | 5.8 | 6.0 | 5.8 | 6.0 |
| Temperature | ° C. | 75 | 75 | 75 | 75 | 75 |
| Time | min | 5 | 5 | 5 | 5 | 5 |

Example 2

According to the components, contents and conditions shown in Table 2, 1 g/L (with respect to gold content) of potassium gold cyanide, 20 g/L of EDTA-2Na, 2 g/L of 3-pyridinecarboxylic acid, 30 g/L of succinic acid, 5 g/L of citric acid, 5 g/L of sodium sulfite, 0.2 g/L of 2-amino-9H-purine-6(H)-one, 50 mg/L of benzotriazole were added to deionized water to prepare a substitution-type electroless gold plating solution according to the present invention.

Potassium hydroxide was added to adjust the pH to 5.8. The test substrate was subjected to gold strike plating for 5 minutes at a plating bath at a temperature of 751 followed by electroless gold plating (NEOZEN TG/product of MK Chem&Tech Company).

Example 3

According to the components, contents and conditions shown in Table 2, 1 g/L (with respect to gold content) of potassium gold cyanide, 20 g/L of EDTA-2Na, 2 g/L of 3-pyridinecarboxylic acid, 40 g/L of oxalic acid, 5 g/L of citric acid, 5 g/L of sodium sulfite, 1.0 g/L of 2,4(1H,3H)-pyrimidine-dione, 50 mg/L of 2-amino-thiazole were added to deionized water to prepare a substitution-type electroless gold plating solution according to the present invention.

Potassium hydroxide was added to adjust the pH to 6.0. The test substrate was subjected to gold strike plating for 5 minutes at a plating bath at a temperature of 75t followed by electroless gold plating (NEOZEN TG/product of MK Chem&Tech Company).

Comparative Example 1

According to the components, contents and conditions shown in Table 2, 1 g/L (with respect to gold content) of potassium gold cyanide, 20 g/L of EDTA-2Na, 2 g/L of 3-pyridinecarboxylic acid, 40 g/L of oxalic acid, 5 g/L of sodium sulfite, 50 mg/L of benzotriazole were added to deionized water to prepare a substitution-type electroless gold plating solution for comparison.

Potassium hydroxide was added to adjust the pH to 5.8. The test substrate was subjected to gold strike plating for 5 minutes at a plating bath at a temperature of 751 followed by electroless gold plating (NEOZEN TG/product of MK Chem&Tech Company).

Comparative Example 2

According to the components, contents and conditions shown in Table 2, 1 g/L (with respect to gold content) of potassium gold cyanide, 20 g/L of EDTA-2Na, 2 g/L of 3-pyridinecarboxylic acid, 30 g/L of succinic acid, 5 g/L of sodium sulfite were added to deionized water to prepare a substitution-type electroless gold plating solution for comparison.

Potassium hydroxide was added to adjust the pH to 6.0. The test substrate was subjected to gold strike plating for 5 minutes at a plating bath at a temperature of 75° C. followed by electroless gold plating (NEOZEN TG/product of MK Chem&Tech Company).

Experimental Example

1. Gold plating thickness: The thickness was measured with an XRF plating layer analyzer and is shown in Table 3 below.

Figure 3:
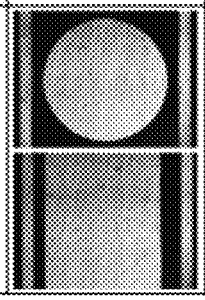
FIG. 3 is a view of photographs illustrating the appearances of gold plating of Examples and Comparative Examples according to a test example of the present invention.
Figure 3:
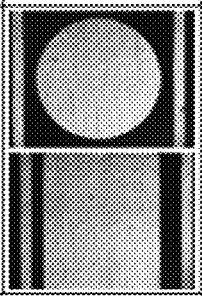
Figure 3:
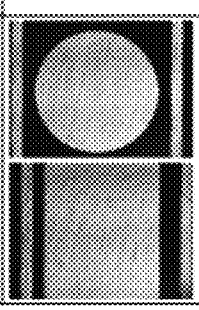
Figure 3:
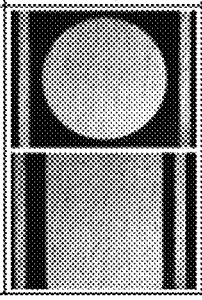
Figure 3:
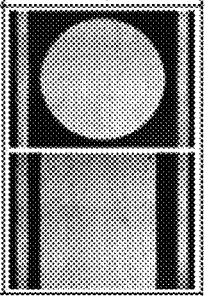

2. Gold-plated appearance (exterior): Appearance of plated test piece was observed with an optical microscope for confirming exterior anomalies such as stains or discoloration and is shown in Table 3 below (see FIG. 3).

Figure 4:
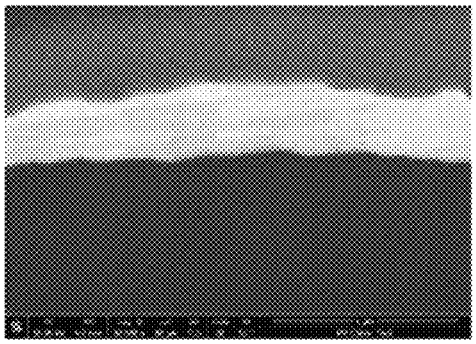
FIG. 4 is a view of photographs illustrating the localized erosion in the plating inter-layer before the heat treatment in Examples and Comparative Examples according to a test example of the present invention.
Figure 4:
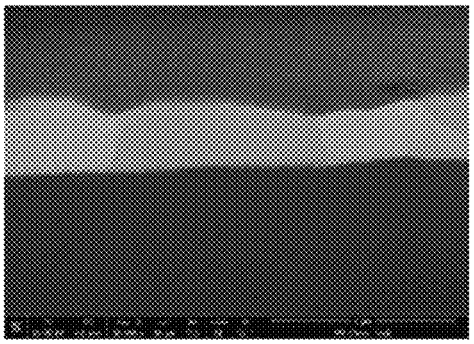
Figure 4:
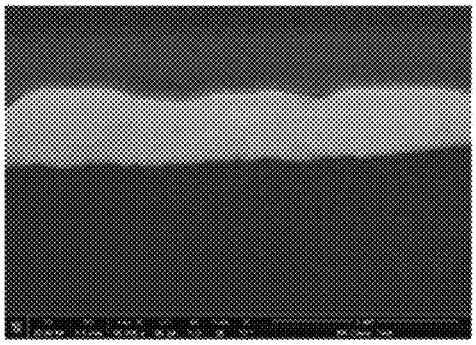
Figure 4:
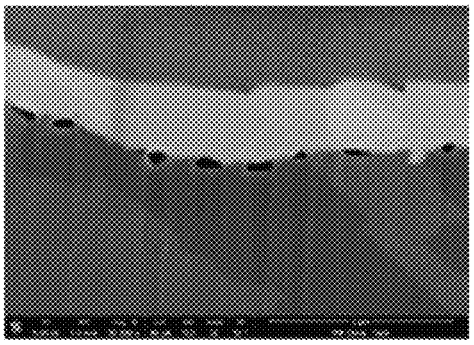
Figure 4:
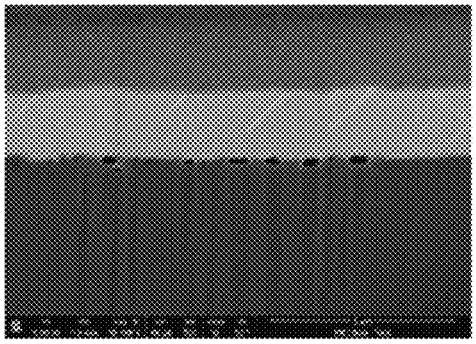

3. Localized corrosion between plated layers before heat-treatment: Using HELIOS 600I focused ion beam analysis (FIB) equipment of FEI Company, a cross-section of 20 μm was processed, and then localized corrosion in the plated layer was observed by scanning electron microscopy (SEM) and is shown in FIG. 4. The presence or absence of such localized corrosion in the plated layer was confirmed and is shown in Table 3 below.

Figure 5:
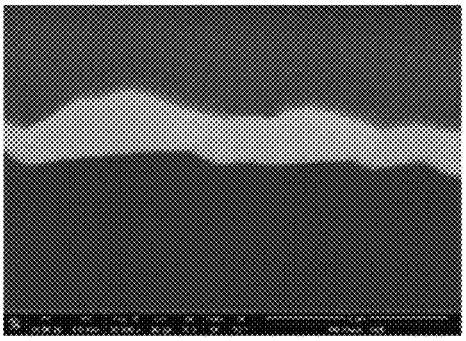
FIG. 5 is a view of photographs illustrating the localized erosion in the plating inter-layer after the heat treatment of the Examples and the Comparative Examples according to a test example of the present invention.
Figure 5:
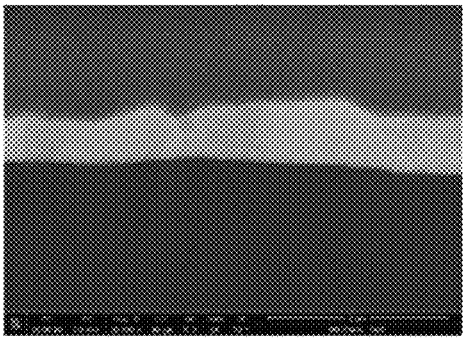
Figure 5:
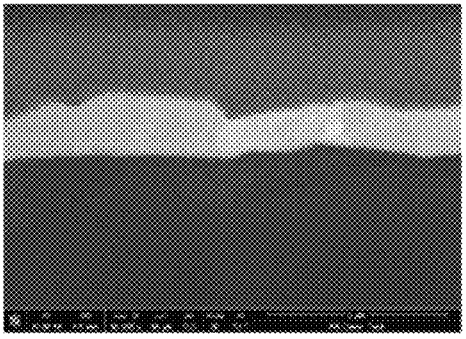
Figure 5:
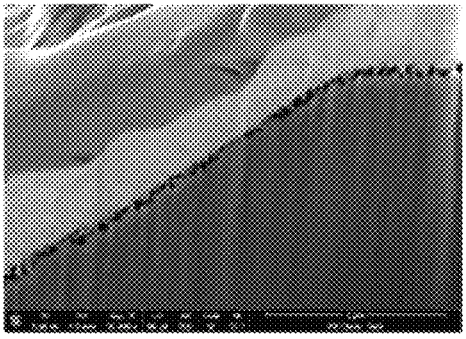
Figure 5:
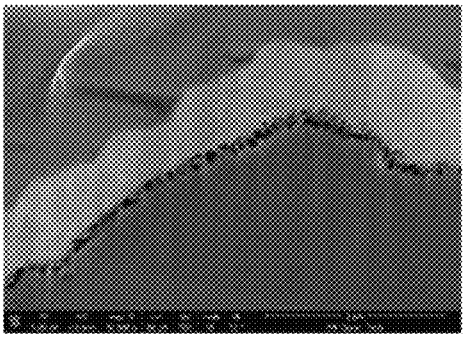

4. Localized corrosion between plated layers after heat-treatment: After the plated test piece was heat-treated in an oven at 175° C. for 24 hours, a 20 μm section was processed by a focused ion beam analysis (FIB) equipment, and localized corrosion in the plated layer was observed by scanning electron microscopy (SEM) and is shown in FIG. 5. The presence or absence of such localized corrosion in the plated layer was confirmed and is shown in Table 3 below.

5. Plating adhesion: It was confirmed by a peel test using a tape whether the base metal and the plating layer were separated and adhered to the tape, and the results are shown in Table 3 below.

Figure 6:
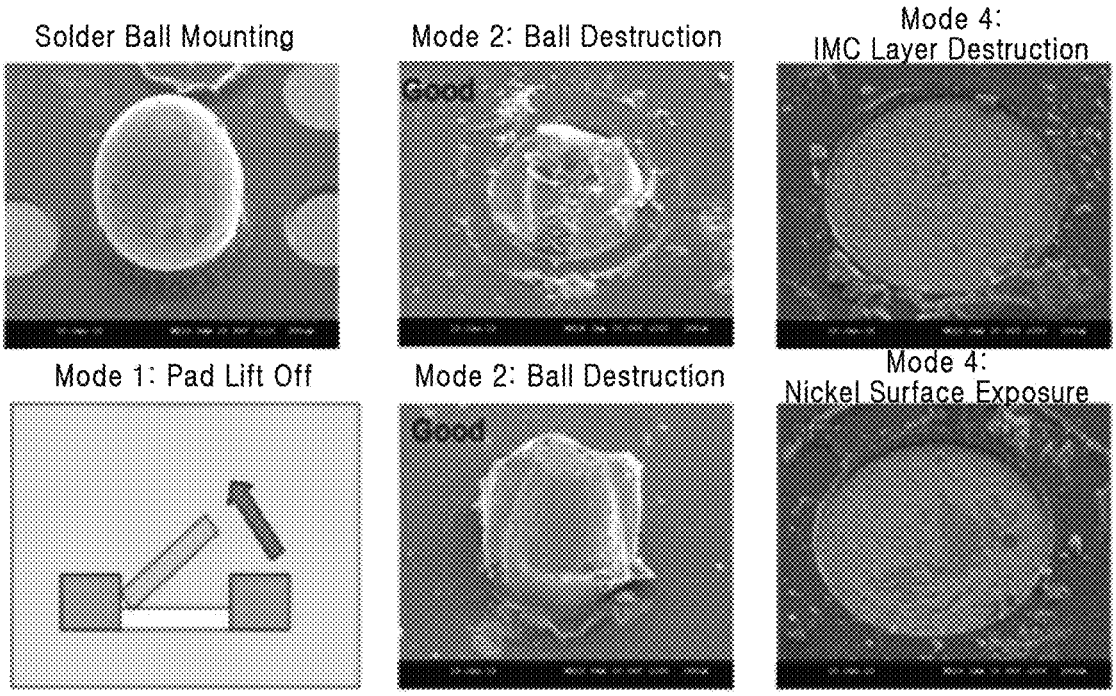
FIG. 6 is a view of photographs showing a solder joint test process according to a test example of the present invention.

6. Solder bonding strength: Tests for the tensile strength and failure mode of the solder balls were performed using a DAGE 4000 device. The pull speed was 5000 μm/sec. The strength of the test piece after plating was measured, and the test was carried out 30 times to obtain an average value. The results are shown in Table 3 below. FIG. 6 is a photograph showing a solder bonding test process.

[Measurement Conditions]

Measurement method: Ball Pull test,

Solder ball: Alpha metal 0.45φ SAC305 (Sn-3.0Ag-0.5Cu),

Reflow: Multi-reflow (BTU, VIP-70),

Reflow conditions: Top 260° C.

Figure 7:
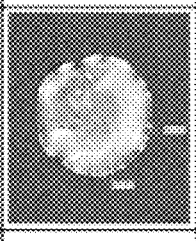
FIG. 7 is a view of photographs showing solder spreadability in Examples and Comparative Examples according to a test example of the present invention.
Figure 7:
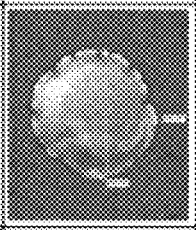
Figure 7:
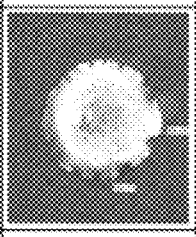
Figure 7:
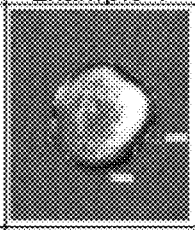
Figure 7:
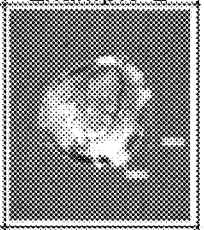

7. Solder spreadability: After spraying the flux as a thin film on the surface of the plated test piece, an alpha metal 0.30 SAC305 (Sn-3.0Ag-0.5Cu) solder ball was put on top and then reflow was treated, and the solder ball that was spread out was measured as (width+length)/2, which is shown in Table 3 below (refer to FIG. 7).

8. Crack resistance test: The crack resistance test was carried out using MIT-DA equipment. One side of the plated test piece was fixed and a weight of 250 g was hung on the other side to straighten out the test piece. The middle portion of the test piece circuit was bent 1350 to the left and right repeatedly until the circuit broke. The number of reciprocations of the bending until breaking was recorded, which is shown in the following Table 3.

9. Circuit blur: The presence or absence of blurring was confirmed by observing a circuit having a space of 20 μm or less after plating, and is shown in Table 3 below.

[Measurement Conditions]

Blur rate (%)=(blur width (um)/circuit width (um)) *100

TABLE 3

| Category | Example1 | Example2 | Example3 | Comparative Example1 | Comparative Example2 |
|---|---|---|---|---|---|
| Gold plating thickness (μm) | 0.072 | 0.078 | 0.075 | 0.070 | 0.073 |
| Gold plating exterior (appearance) | Good | Good | Good | Good | Good |
| Void between layer of plated layer before heat-treatment | No | No | No | Yes | Yes |
| Void between layer of plated later after heat-treatment | No | No | No | Yes | Yes |
| Plating adhesion | Good | Good | Good | Good | Partial |
| Solder bonding strength (gf) | 712.24 | 708.35 | 723.29 | 667.75 | 631.79 |
| Solder spreadability (μm) | 833.50 | 871.47 | 855.57 | 626.32 | 609.38 |
| Crack resistance test | 182 | 178 | 188 | 172 | 173 |
| Circuit blur | 0% | 0% | 0% | 2% | 3% |

From the above Table 3, it can be seen that the gold plating films of Examples 1 to 3 of the present invention were formed by using a purine or pyrimidine compound each having carbonyl oxygen, a sulfite compound as a gold ion stabilizer and an azole compound as a surface corrosion inhibitor as needed. Thereby it was possible to obtain uniform gold plating having a thickness of 0.06 m or more without any localized corrosion on the copper surface which shows that the gold plating has excellent solder jointability and spreadability. As a result of the crack resistance test, it can be seen that ductility was improved after reflow and bending resistance is also excellent.

On the other hand, the gold plating films deposited in Comparative Examples 1 and 2 had a problem in that when the purine and pyrimidine-based compounds were not used as the localized corrosion inhibitors on the copper surface, pitting or crevice corrosion was formed on the copper surface. It can be seen that due to such corrosion, the solder jointability and spreadability as well as plating adhesion was insufficient.

While the present invention has been particularly shown and described with reference to exemplary embodiments thereof, it is evident that many alternatives, modifications and variations will be apparent to those skilled in the art. It will be understood by those skilled in the art that various changes in form and details may be made therein without departing from the spirit and scope of the invention as defined by the appended claims.

In addition, since the present invention can be embodied in various forms, and should not be construed as being limited to the embodiments set forth herein.

Rather, these embodiments are provided so that this disclosure will be thorough and complete and will fully convey the concept of the invention to those skilled in the art, and the present disclosure will only be defined by the appended claims.

The present invention relates to a new substitution-type electroless gold plating in which electroless gold plating is directly applied to a copper wiring of a printed circuit board. Since the present invention is suitable for flexible substrates that require the flexibility reliability of a substrate of a very fine circuit with a line/space of 10 μm or less, and a substrate for high frequency, it is industrially applicable in the field of printed circuit board manufacturing using the same.

The present invention is new substitution-type electroless gold plating fundamentally solving the problem of fatal localized corrosion in the case of direct gold plating on a copper surface. The present invention is a new plating method which can be used as a gold strike on the copper surface is proposed for the first time in the industry. Since the substitution-type electroless gold strike plating method of the present invention can be used in place of not only direct electroless gold plating methods, but also in place of the ENEPIC method wherein electroless nickel plating can be omitted since it can also be used with electroless palladium plating as a base metal.

What is claimed is:

1. A substitution-type electroless gold plating solution comprising, (A) a purine-based compound or a pyrimidine-based compound each having a carbonyl oxygen, as a localized corrosion inhibitor;

(B) a water-soluble gold compound;

(C) a complexing agent;

(D) a dicarboxylic acid as a conductivity improving agent;

(E-1) a nitrogen-containing heteroaryl carboxylic acid and (E-2) an α-hydroxycarboxylic acid as (E) a base metal elution and re-precipitation preventing agent, wherein the nitrogen in the heteroaryl carboxylic acid is located on a heteroaryl ring and are all shown as aromatic nitrogen; and (F) a cyanide compound or a sulfite compound as a gold ion stabilizer, wherein the carbonyl oxygen is contained in any one of the following chemical formulas a to c:

<chemical formula a>

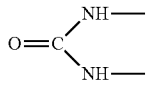

<chemical formula b>

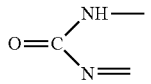

<chemical formula c>

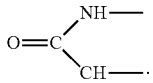

2. The solution of claim 1, wherein the (A) purine-based compound or the pyrimidine-based compound each having carbonyl oxygen, as the localized corrosion inhibitor, is one or more selected from the group consisting of 2-amino-9H-purine-6(H)-one, 3,7-dihydro-purine-2,6-dione, 7,9-dihydro-1H-purine-2,6,8(3H)-trione, 5-methyl-pyrimidine-2,4(1H,3H)-dione, 2,4(1H,3H)-pyrimidine-dione, and 4-amino-1H-pyrimidine-2-one.

3. The solution of claim 1, wherein the (B) water-soluble gold compound is one or more selected from the group consisting of, potassium gold (I) cyanide, potassium gold (III) cyanide, potassium gold (I) chloride, potassium gold (III) chloride, gold potassium sulfite, gold sodium sulfite, gold potassium thiosulfate, gold sodium thiosulfate, and a mixture thereof.

4. The solution of claim 1, wherein the (C) complexing agent is one or more selected from the group consisting of, ethylene diamine tetraacetic acid (EDTA), diethylenetriamine pentaacetic acid (DTPA), triethylenetetramine hexaacetic acid, propane diamine tetraacetic acid, N-(2-hydroxyethyl)ethylene diamine triacetic acid, 1,3-diamino-2-hydroxypropane N, N, N', N'-tetraacetic acid, bis-(hydroxyphenyl)-ethylenediamine diacetic acid, diaminocyclohexane tetraacetic acid, ethylene glycol-bis ((β-aminoethyl ether)-N, N'-tetraacetic acid), N, N, N', N'-tetrakis-(2-hydroxypropyl)-ethylenediamine, ethylenediamine, triethylenetetramine, diethylenetriamine, tetrakis (aminoethyl)ethylenediamine, a sodium, potassium or ammonium salt thereof, and a mixture thereof.

5. The solution of claim 1, wherein the (D) dicarboxylic acid as the conductivity improving agent is one or more selected from the group consisting of oxalic acid, malonic acid, succinic acid, glutaric acid, adipic acid, pimelic acid, suberic acid, azelaic acid, sebacic acid, undecanoic acid, dodecanoic acid, 3,3-dimethylentanoic acid, cyclopentane dicarboxylic acid, cyclohexane dicarboxylic acid, and a mixture thereof.

6. The solution of claim 1, wherein the (E-1) nitrogen-containing heteroaryl carboxylic acid is one or more selected from the group consisting of imidazole carboxylic acid, imidazole dicarboxylic acid, pyridine carboxylic acid, pyridine dicarboxylic acid, pyrimidine carboxylic acid, pyrimidine dicarboxylic acid, pyridazine carboxylic acid, pyridazine dicarboxylic acid, a pyrazine carboxylic acid, pyrazine dicarboxylic acid, and a mixture thereof.

7. The solution of claim 6, wherein the (E-1) nitrogen-containing heteroaryl carboxylic acid is selected from the group consisting of imidazole-2-carboxylic acid, imidazole-4-carboxylic acid, imidazole-2,4-dicarboxylic acid, imidazole-4,5-dicarboxylic acid, pyridine-2-carboxylic acid (picolinic acid), pyridine-3-carboxylic acid (nicotinic acid), pyridine-4-carboxylic acid (isonicotinic acid), pyridine-2,3-dicarboxylic acid, pyridine-2,4-dicarboxylic acid, pyridine-2,5-dicarboxylic acid, pyridine-2,6-dicarboxylic acid, pyrimidine-3,4-dicarboxylic acid, pyrimidine-3,5-dicarboxylic acid, pyrimidine-2-carboxylic acid, pyrimidine-4-carboxylic acid, pyrimidine-5-carboxylic acid, pyrimidine-2,4-dicarboxylic acid, pyrimidine-2,5-dicarboxylic acid, pyrimidine-4,5-dicarboxylic acid, pyrimidine-4,6-dicarboxylic acid, pyridazine-3-carboxylic acid, pyridazine-4-carboxylic acid, pyridazine-3,4-dicarboxylic acid, pyridazine-3,5-dicarboxylic acid, pyridazine-4,5-dicarboxylic acid, pyrazine-2-carboxylic acid, pyrazine-2,3-dicarboxylic acid, pyrazine-2,5-dicarboxylic acid, pyrazine-2,6-dicarboxylic acid, and a mixture thereof.

8. The solution of claim 1, wherein the (E-2) α-hydroxycarboxylic acid is one or more selected from the group consisting of glycolic acid, lactic acid, hydroxybutyric acid, hydroxyvaleric acid, hydroxypentanoic acid, hydroxycaproic acid, hydroxyheptanoic acid, malic acid, tartaric acid, citric acid, and a mixture thereof.

9. The solution of claim 1, wherein the (F) gold ion stabilizer is a sulfite compound having a sulfite group ($SO_3^{2-}$).

10. The solution of claim 1, further comprising a (G) surface corrosion inhibitor and excluding the (A) localized corrosion inhibitor.

11. The solution of claim 10, wherein the (G) surface corrosion inhibitor comprises an azole compound having one or more nitrogen atoms and two or more other elements in a 5-membered heterocycle.

12. The solution of claim 1, further comprising (H) an other additive, wherein the other additive is one or more selected from the group consisting of, a surfactant, a crystallization modifier, a pH adjuster, and a buffer.

13. A substitution-type electroless gold plating method comprising, preparing a substrate to be plated having a metal surface selected from copper or a copper alloy, and bringing the substrate into contact with the substitution-type electroless gold plating solution according to claim 1.

* * * * *